United States Patent [19]

Baumann

[11] 4,293,007

[45] Oct. 6, 1981

[54] HOLDING DEVICE FOR THE ELECTRICAL CONTACT ELEMENTS OF A WRAP STOP MOTION OF A WEAVING MACHINE

[75] Inventor: Hans Baumann, Horgen, Switzerland

[73] Assignee: Sulzer Brothers Limited, Winterthur, Switzerland

[21] Appl. No.: 143,772

[22] Filed: Apr. 25, 1980

[30] Foreign Application Priority Data

May 8, 1979 [CH] Switzerland ..... 4299/79

[51] Int. Cl.[3] ..... D03D 51/28

[52] U.S. Cl. ..... 139/358; 139/369

[58] Field of Search ..... 139/353, 358, 360, 369; 66/163

[56] References Cited

U.S. PATENT DOCUMENTS 2,342,752 2/1944 Payne ..... 139/358
2,668,563 2/1954 Palombo ..... 139/358
3,343,572 9/1967 Geiger ..... 139/358
3,584,659 6/1971 Pfarrwaller ..... 139/369
3,794,084 2/1974 Faveri ..... 139/369

FOREIGN PATENT DOCUMENTS 526721 3/1954 Belgium ..... 139/353

*Primary Examiner*—Henry Jaudon
*Attorney, Agent, or Firm*—Kenyon & Kenyon

[57] ABSTRACT

The holding device is provided with a shaped body for raising and lowering the plate-shaped element located within the fixedly mounted support. The shaped body may be in the form of a wedge shaped body or in the form of an eccentric. Suitable means are provided for holding the wedge shaped body in place. Raising and lowering of the plate-shaped elements allows the electrical contact elements to be raised and lowered to adapt to the operating conditions of the weaving machine.

15 Claims, 5 Drawing Figures

HOLDING DEVICE FOR THE ELECTRICAL CONTACT ELEMENTS OF A WRAP STOP MOTION OF A WEAVING MACHINE

This invention relates to a holding device for electrical contact elements. More particularly, this invention relates to a holding device for the electrical contact elements of a warp stop motion of a weaving machine.

As is known, various types of warp stop motions have been used in weaving machines to stop the machine upon the occurrence of a warp yarn break. In many cases, use is made of electrical contact elements which extend transversley across the width of the weaving machine and droppers which are individually mounted on each warp yarn over a respective contact element. Should a warp yarn break, the dropper falls under gravity onto the electrical contact element and completes an electrical circuit to cause stopping of the weaving machine. In some cases, the electrical contact elements are mounted in an adjustable plate-like element of a holding device. Further, as described in U.S. Pat. No. 3,584,659, such a plate-type element can be adjusted in height relative to a fixed support by means of an elongated slot on the support and a clamping screw which passes through the slot into threaded engagement with the plate-like element. If the weaving width of the weaving machine is large, several such supports with displacable like elements are required in order to hold the contact elements of the warp stop motion extending over the weaving width. However, with the known adjusting means, it is difficult to bring about the same height position for the individual holding devices and plate type elements so that the contact elements of the warp stop motion have exactly the same position over the entire weaving width and extend horizontally as a rule.

Accordingly, it is an object of the invention to be able to adjust the height of the plate shaped elements of a plurality of holding devices for a warp stop motion in an easy and exact manner.

It is another object of the invention to be able to provide holding devices for supporting the electrical contact elements of a warp stop motion in an adjustable manner.

It is another object of the invention to insure that the electrical contact elements of a warp stop motion have the same height throughout.

It is another object of the invention to be able to vary the height of the electrical contact elements of a warp stop motion and thus the height of all of the droppers in order to adapt to the particular conditions of the weaving machine.

It is another object of the invention to be able to adjust the warp stop motion of a weaving machine to the position of a tension beam of the machine, the height of open shed of the machine and the type of warp yarn used.

Briefly, the invention provides a holding device for the electrical contact elements of a warp stop motion of a weaving machine. The holding device is comprised of a fixedly mounted support, a plate-shaped element which is movably mounted on the support and has a plurality of slots at one end for receiving a plurality of contact elements therein and a shaped body which is movably mounted between the plate-shaped element and support for displacing the element relative to the support.

With a series of holding devices disposed across the width of a weaving machine, the adjustment of the various plate-shaped elements allows the position of the contact elements of the warp stop motion to be exactly alike. Thus, a false shutting off of the weaving machine by the warp stop motion can be avoided.

In one embodiment, the shaped body is wedge shaped and is slidably mounted on the support. Thus, by moving the wedge shaped body along the support, the plate-shaped element can be raised or lowered to adjust the height of the electrical contact elements. In this embodiment, the wedge shaped body may be provided with a serrated surface for mating engagement with a serration on the support. Also, the support may be provided with a pair of walls between which the plate shaped element is guided while the wedge shaped body has a guide projection protruding between the walls.

In another embodiment, the shaped body may be an eccentric which is rotatably mounted in one of the plate shaped element and support. To this end, the eccentric may have a circular periphery or a polygonal periphery, for example for engaging the lower end of the plate-shaped element so as to raise and lower the plate-shaped element.

These and other objects and advantages of the invention will become more apparent from the following detailed description taken in conjunction with the accompanying drawings wherein.

Figure 1:
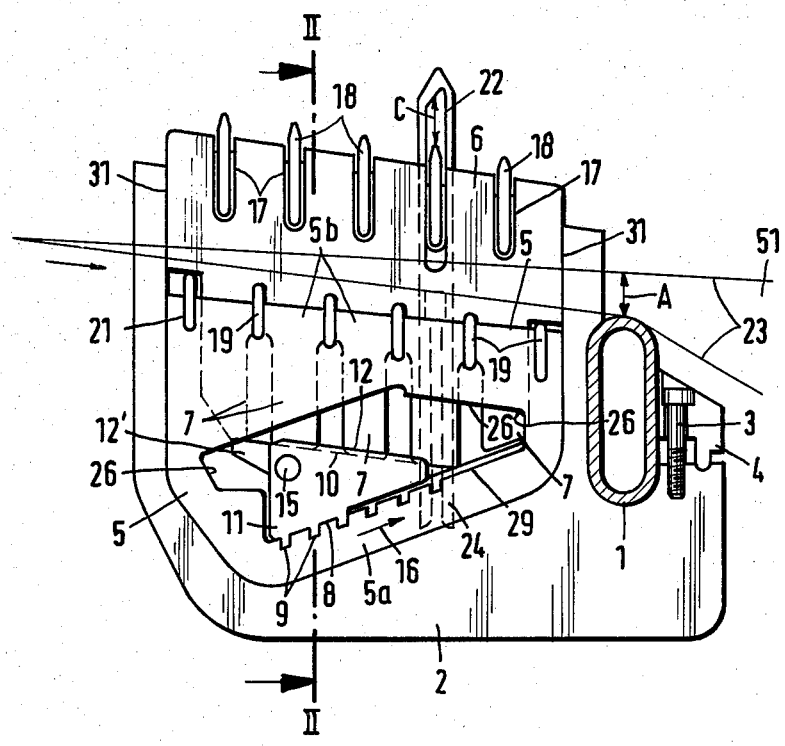
FIG. 1 illustrates a side view of a holding device constructed in accordance with the invention.

Referring to FIG. 1, the weaving machine includes a frame on which a transverse rod 1 of oval cross-section is mounted. The rod 1 extends in the weft direction and serves as a fixed support for a plurality of holding devices only one of which is shown for simplicity.

Figure 2:
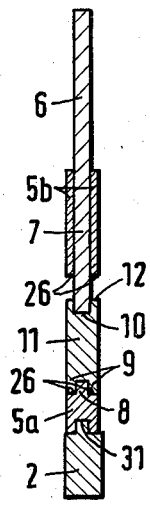
FIG. 2 illustrates a view taken on line II—II of FIG. 1.

Referring to FIGS. 1 and 2, each holding device includes a frame 2 which is fixedly mounted on the rod 1 in cantilevered manner by means of a chucking wedge 4 and a bolt 3. In addition, a support 5 is fitted into a U-shaped recess of the frame 2. This support 5 has a solid lower portion **5*a* and a pair of spaced apart parallel walls 5*b* defining an upper double wall portion. The frame 2 has an obliquely extending surface at the bottom of the recess and has a guide 31 (see FIG. 2) surrounding the recess while the lower portion 5*a* of the support 5 is similarly sloped and shaped to fit on the guide 31. The support 5 also has an opening 26 and a sloped surface on the upper surface of the lower portion 5*a* in which a serration 8 is provided. The upper end of the support walls 5*b* have slots 19 receiving transverse guide bars 21**.

The holding device also has a plate-shaped element 6 movably mounted on the support 5 between the walls **5*b*. This element is also shaped to fit in the recess of the frame 2 on the guide 31. The element 6 has a plurality of feet 7 at the lower end which are of varying length with the lower ends of some of the feet lying in a common inclined plane 10 (see FIG. 1). The element 6 also has a plurality of slots 17 at the upper end for receiving electrical contact elements 18**.

The holding device also has a shaped body 11 in the form of a wedge-shape which is movably mounted between the support 5 and the element 6 for displacing the element 6 relative to the support 5. This wedge-shaped body 11 has a serrated surface formed by teeth 9 on the underside which are matingly received in the serration 8 to fix the body 11 against movement along and transversely of a sloped surface 26 on the upper surface of the lower portion 5*a* of the support 5. The upper surface of the body 11 has a channel 12 to form a guide for the feet 7 of the element 6 (see FIG. 2). In addition, the body 11 has a guide projection 12' protruding into the space between the walls 5*b* as well as a bore 15 near the projection 12'.

Referring to FIG. 1, a plurality of droppers 22 (only one of which is shown), each with a pair of feet 24, are mounted over the contact elements 18 in known manner and are supported on individual warp yarns 23 so as to drop onto a contact element over a height of fall C in response to breaking of a warp yarn. Dropping of a dropper 22 onto a contact element 18 serves to stop the weaving machine in known manner. The guide bars 19 hold the droppers 22 on the respective contact elements 18 in spaced relation as is known with the feet 24 between pairs of guide bars 19. The warp yarns 23 are formed into a shed 51 in known manner with the yarns 23 of the shed 51 above the rod 1 being spaced apart by a pre-set distance A.

In order to change the spacing A or to raise the contact elements 18, the wedge-shaped body 11 is shifted to the rights as viewed in FIG. 1. To this end, the body 11 is lifted from the serration 8, for example, by insertion of a tool in the bore 15 and pushed in the direction indicated by the arrow 16. In so doing, the body 11 moves under the feet 7 and the element 6 is raised.

Figure 3:
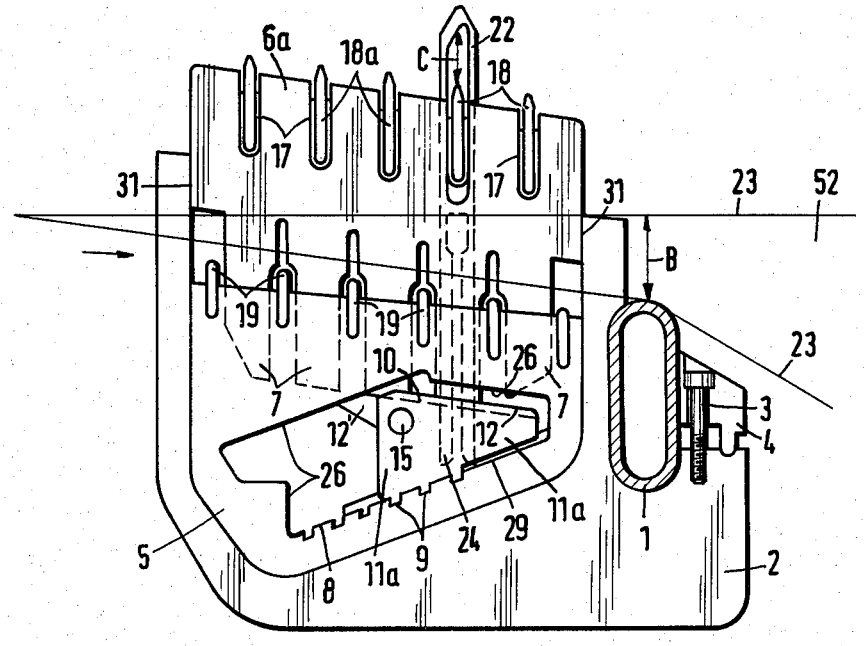
FIG. 3 illustrates a view similar to FIG. 1 of the holding device with a plate-shaped element in a raised position.

After displacement of body 11 in the frame of the opening 26 of the support 5, the body 11 reaches e.g. the position 11*a* shown in FIG. 3 wherein like reference characters indicate like parts as above. The element 6 is thus positioned in the higher position 6*a*. This position corresponds to the greater spacing B, assumed in FIG. 3, of the warp threads 23 when the shed 52 is larger. The contact bars are also in a high position 18*a*. The time of fall of a dropper 22 in the case of a warp yarn break is the same as for the position according to FIG. 1, since, in both positions, the distance C between the contact element 18 and the upper end of the respective slot of the dropper 22 is the same.

The frame 2 can be made, for example of a metallic material such as cast aluminum, while the support 5 and element 6 are made of plastic, e.g. nylon or Teflon (tetrafluoreothylene). The weight of the contact elements 18 and guide bars 19 serve to push the element 6 and support 5 downward as viewed so that the teeth 9 are continuously held in the serration 8 and the body 11 cannot skid to the left.

Due to the serration 8, a stepwise adjustment of the body 11 can be obtained at every support of the warp stop motion. If desired, indicia, e.g. numbers, can be provided at the individual gaps of the serration 8, so as to easily obtain the same position at every frame 2 or body 11 over the full weaving width of the machine. In this way, the contact bars 18 can be positioned at exactly the same level while extending horizontally.

The holding device is such that the wedge shaped body 11 makes positive contact on the sloped surface 29 or the serration 8, as does also the element 6 on the body 11. Clamping parts such as screws or the like are not necessary. The arrangement is particularly easy to adjust and to adapt to the existing conditions.

In a modified construction (not shown) the sloped surface 29 on the support 5 may be omitted. The serration 8 then extends horizontally. The incline formed by the feet 7 according to the straight line 10 will then show a correspondingly different slope. The form of the wedge-shaped body 11 may be different. At least one of the parts 5, 6 must be provided with a sloped surface, by which, upon displacement of the sliding body 11 between the parts 5, 6 an adjustment in height of the element 6 can be effected.

If the slope of sloped surface 29 and of the guide 12 is small, a serration 8 may be omitted. The wedge-shaped body 11 can then be displaced on the sloped surface 29 steplessely; self-locking can be achieved by the slight inclination of the parts 29, 12. The same position of the body 11 in every support 5 of the warp stop motion can be achieved in this case, for example by applying suitable marks.

If the parts 5, 11 are made of sufficiently rough material, or if their sides which slide on one another are sufficiently rough, a serration 8 can be omitted even at a relatively large slope of the sloped surface 29. If a serration is provided, the teeth 9 as well as the corresponding gaps in the lower portion 5*a* may be more or less rounded.

Figure 4:
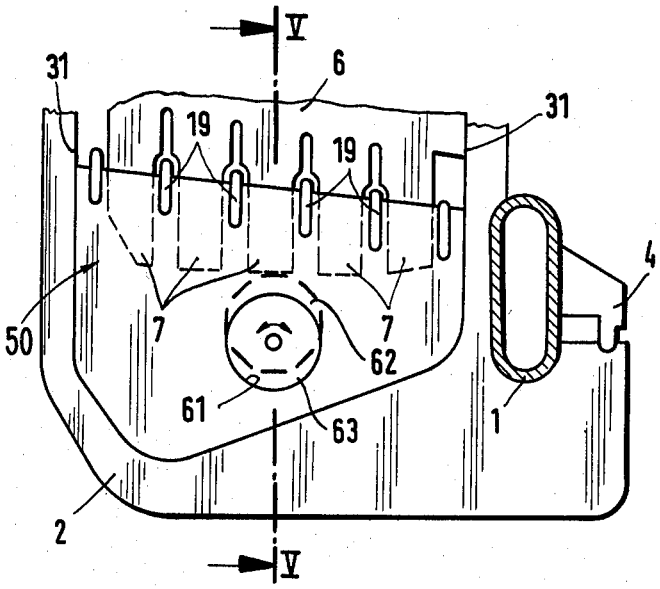
FIG. 4 illustrates a side view of a modified holding device in accordance with the invention.
Figure 5:
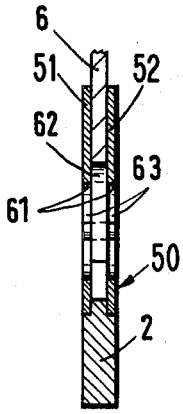
FIG. 5 illustrates a view taken on line V—V of FIG. 4.

Referring to FIGS. 4 and 5 wherein like reference characters indicate like parts as above, the support 50 is formed of two separate plates 51, 52 as shown in FIG. 5 while the shaped body for establishing a drive connection between the support 50 and the plate-like element 6 may be in the form of an eccentric 62 which is rotatably mounted in the support 50. As shown in FIG. 5, the eccentric 62 has a pair of circular shims 63 which are rotatably mounted in bores 61 in the plates 51, 52 of the support 50 while the periphery of the eccentric 62 is polygonal and abuts the lower end of one or more feet 7 of the element 6. Upon rotation of the eccentric 62 via the shims 63, the height of the element 6 can be changed in a stepwise manner.

Alternatively, the periphery of the eccentric 62 can be cylindrical so that upon rotation of the eccentric 62, the element 6 can be moved in a stepless manner.

The invention thus provides a holding device for the electrical contact elements of a warp stop motion which permits the contact elements to be raised or lowered accurately to obtain a horizontal position corresponding to a particular shed across the width of the weaving machine.

The invention also provides a holding device in which a height adjustment can be made in a relatively easy exact manner.

I claim:

1. A holding device for electrical contact elements of a warp stop motion of a weaving machine, said holding device comprising a fixedly mounted support;

a plate-shaped element movably mounted on said support and having a plurality of slots at one end for receiving a plurality of contact elements therein; and a shaped body movably mounted between said element and said support for displacing said element relative to said support.

2. A holding device as set forth in claim 1 wherein said body is a wedge-shaped and is slidably mounted on said support, and wherein one of said element and said support has a sloped surface engaging said body.

3. A holding device as set forth in claim 2 wherein said sloped surface has a serration therein for matingly receiving a serrated surface on said body.

4. A holding device as set forth in claim 1 wherein said support has a pair of walls defining a double wall portion and said element is slidably guided in said double wall portion.

5. A holding device as set forth in claim 4 wherein said body has a guide projection protruding between said walls.

6. A holding device as set forth in claim 1 wherein said support has a plurality of slots therein for receiving transverse guide bars.

7. A holding device as set forth in claim 1 wherein said body is an eccentric rotatably mounted in one of said element and said support.

8. A holding device as set forth in claim 7 wherein said eccentric has a polygonal periphery.

9. A holding device as set forth in claim 1 which further comprises a frame having a U-shaped recess receiving said support and said element therein.

10. A holding device as set forth in claim 9 wherein said support has a pair of walls defining a double wall portion and said elements is slidably guided in said double wall portion.

11. A holding device as set forth in claim 10 wherein said body is a wedge-shaped and is slidably mounted on said support, and wherein one of said element and said support has a sloped surface engaging said body.

12. A holding device as set forth in claim 11 wherein said body has a guide projection protruding between said walls.

13. In a warp stop motion for a weaving machine, the combination comprising a plurality of electrical contact elements;

a plurality of droppers, each said dropper being disposed over a respective contact element to drop onto said respective contact element in response to breaking of a warp yarn supporting said respective dropper over said respective contact elements; and at least one holding device for mounting said contact elements therein, said holding device including a support, a plate-shaped element mounted on said support and having a plurality of slots at one end receiving said contact elements therein, and a shaped body movably mounted between said plate-shaped element and said support for displacing said plate-shaped element relative to said support to raise and lower said contact elements.

14. The combination as set forth in claim 13 wherein said body is a wedge-shaped and is slidably mounted on said support, and wherein one of said element and said support has a sloped surface engaging said body.

15. The combination as set forth in claim 13 wherein said body is an eccentric rotatably mounted in one of said element and said support.

* * * * *

UNITED STATES PATENT AND TRADEMARK OFFICE

CERTIFICATE OF CORRECTION

PATENT NO. : 4,293,007

DATED : October 6, 1981

INVENTOR(S) : Hans Baumann

It is certified that error appears in the above—identified patent and that said Letters Patent is hereby corrected as shown below:

On the title page,(in title) after "Elements Of A" change "Wrap" to -- Warp --.

Column 3, line 46, after "also in a" change "high" to -- higher --.

Column 6, line 15, after "contact" change "elements" to -- element --.

Signed and Sealed this

*Nineteenth* Day of *January 1982*

[SEAL]

*Attest:*

GERALD J. MOSSINGHOFF

*Attesting Officer*

*Commissioner of Patents and Trademarks*